US009113733B2

(12) United States Patent
Wu

(10) Patent No.: US 9,113,733 B2
(45) Date of Patent: Aug. 25, 2015

(54) VENTILATION CUP LID

(71) Applicant: YI SHEN PLASTIC CORP., Chang Hua Hsien (TW)

(72) Inventor: Yen-Sheng Wu, Chang Hua Hsien (TW)

(73) Assignee: Yi Shen Plastic Corp., Chanh Hua Hsien (TW)

( * ) Notice: Subject to any disclaimer, the term of this patent is extended or adjusted under 35 U.S.C. 154(b) by 99 days.

(21) Appl. No.: 13/947,802

(22) Filed: Jul. 22, 2013

(65) Prior Publication Data

US 2015/0021345 A1 Jan. 22, 2015

(51) Int. Cl.
*A47G 19/22* (2006.01)
*B65D 47/08* (2006.01)

(52) U.S. Cl.
CPC ..... *A47G 19/2272* (2013.01); *B65D 47/0847* (2013.01); *B65D 2543/00046* (2013.01)

(58) Field of Classification Search
CPC ..... A47G 19/22; A47G 19/2272; B65D 2543/0046; B65D 47/06; B65D 47/0847
USPC ..... 220/254.3, 712–714, 716, 717, 719, 220/825; 229/404, 906.1
See application file for complete search history.

(56) References Cited

U.S. PATENT DOCUMENTS

| | | | | |
|---|---|---|---|---|
| 6,929,143 | B2 | 8/2005 | Mazzarolo | |
| 2009/0032543 | A1* | 2/2009 | Lee et al. | 220/713 |
| 2011/0011863 | A1* | 1/2011 | Hollis et al. | 220/254.3 |

* cited by examiner

*Primary Examiner* — Fenn Mathew
*Assistant Examiner* — James N Smalley
(74) *Attorney, Agent, or Firm* — Muncy, Geissler, Olds & Lowe, P.C.

(57) ABSTRACT

A ventilation cup lid includes a lid, a sealing portion to mount the lid onto a cup and an orifice sealing member located on the lid. The lid has a drinking orifice, a severed coupling portion extended from the lid to the drinking orifice, and a wedge notch. The orifice sealing member includes a cover sheet, a protrusive latch portion located at one side of the cover sheet remote from the cup, and a bent connecting section to bridge the cover sheet and lid. The cover sheet and lid are interposed by a ventilation gap. The severed coupling portion strides the ventilation gap to connect to the cover sheet. The ventilation gap forms an exit to release thermal pressure and enhance heat dissipation efficacy. The force applied by users to push the protrusive latch portion to open the cover sheet and expose the drinking orifice also is reduced.

4 Claims, 6 Drawing Sheets

VENTILATION CUP LID

FIELD OF THE INVENTION

The present invention relates to a cup lid and particularly to a ventilation cup lid.

BACKGROUND OF THE INVENTION

In order to facilitate user fetching and carrying, the general drink containers for takeout beverage are mainly made of paper or plastics and have an opening sealed by a sealing film or a cup lid to prevent the beverage from spilling during carrying or inadvertent toppling. However, the cup with sealed opening generally is not desirable to hold hot beverage. One of the concerns is that the sealing material tends to generate toxic material when heated and create safety issue. Hence the opening-sealed cups and material thereof mostly are used to hold cold beverage.

For general hot drink, a cover lid is commonly employed, especially for hot coffee brewed onsite, as the aroma of the coffee must be generated through boiling water. Because its temperature is usually higher than the general hot drink, it is not suitable to seal the cup opening through a sealing film. Hence the cup opening generally is sealed by a specially made cup lid. For instance, U.S. Pat. No. 6,929,143 discloses a "Plastic drink-through cup lid with fold-back tab". Its cup lid has a protrusive structure to be pushed for lifting to reveal the cup opening to facilitate user drinking.

The protrusive structure is integrally formed with the cup lid, and the connecting position between the protrusive structure and cup lid has to be severed through a cutter, but still maintains connection between them without fully cut off. When in use, a user has to push the protrusive structure to break off the connection and separate the cup lid. Such a cup lid structure has disadvantages, notably:

1. The connection between the protrusive structure and cup lid is severed via a cutter, but not fully cut off. User has to apply a substantial force to break off the connection between the protrusive structure and cup lid. It cannot fully meet use requirement.
2. Since the cup lid is incorporated with a cup to contain liquid of a higher temperature, the cup lid has to be perforated through an extra process to avoid the problem of thermal pressure and facilitate heat dissipation. There are still rooms for improvement in terms of heat dissipation and air permeability efficacy.

SUMMARY OF THE INVENTION

The primary object of the present invention is to solve the problem of air permeability of a cup lid for holding hot drink.

To achieve the foregoing object, the present invention provides a ventilation cup lid to cover a cup. The ventilation cup lid includes a lid, a sealing portion connected to one side of the lid, and an orifice sealing member located on the lid. The lid has a drinking orifice, a severed coupling portion extended from the lid to the drinking orifice, and a wedge notch. The sealing portion mates the opening of the cup to enable the lid to be securely mounted onto the cup. The orifice sealing member corresponds to the drinking orifice and includes a cover sheet, a protrusive latch portion located at one side of the cover sheet remote from the cup, and a bent connecting section to bridge the cover sheet and lid. The bent connecting section is located between the wedge notch and cover sheet. The cover sheet and lid are interposed by a ventilation gap. The severed coupling portion strides the ventilation gap to connect to the cover sheet. The cover sheet is mounted onto the drinking orifice through the severed coupling portion and bent connecting section.

By means of the structure set forth above, compared with the conventional techniques, the invention provides features as follows:

1. The ventilation gap between the cover sheet and lid can improve heat dissipation and pressure balance efficacy.
2. As the cover sheet and lid are connected merely by the severed coupling portion, the protrusive latch portion can be easily pushed by a user to break off the connection between the cover sheet and lid to better meet use requirement.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
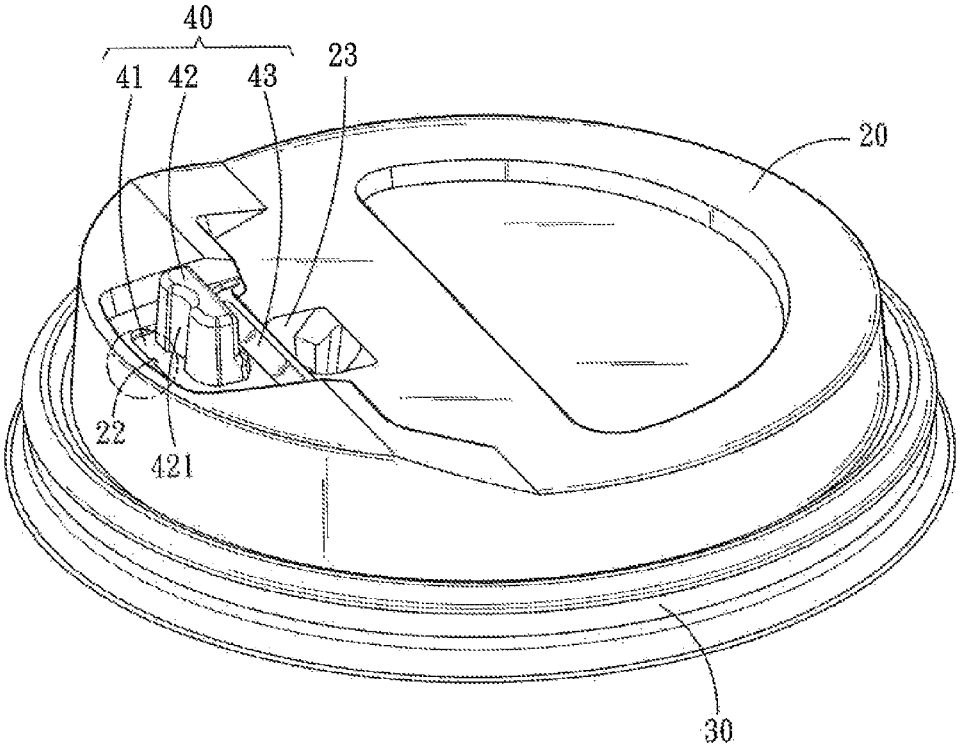
FIG. 1A is a perspective view of the invention.
Figure 1B:
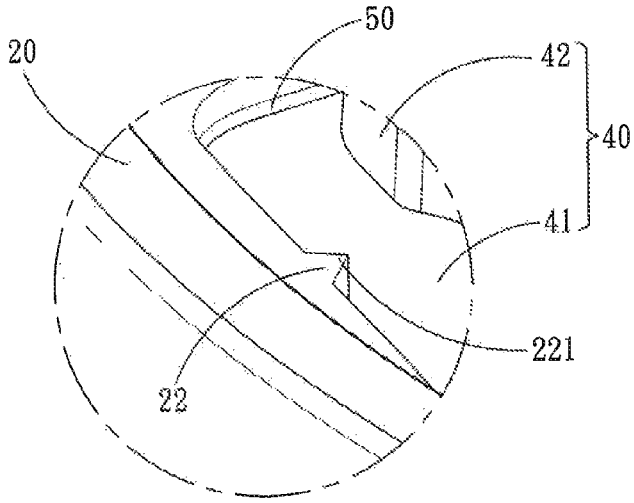
FIG. 1B is a fragmentary enlarged view according to FIG. 1A.
Figure 2A:
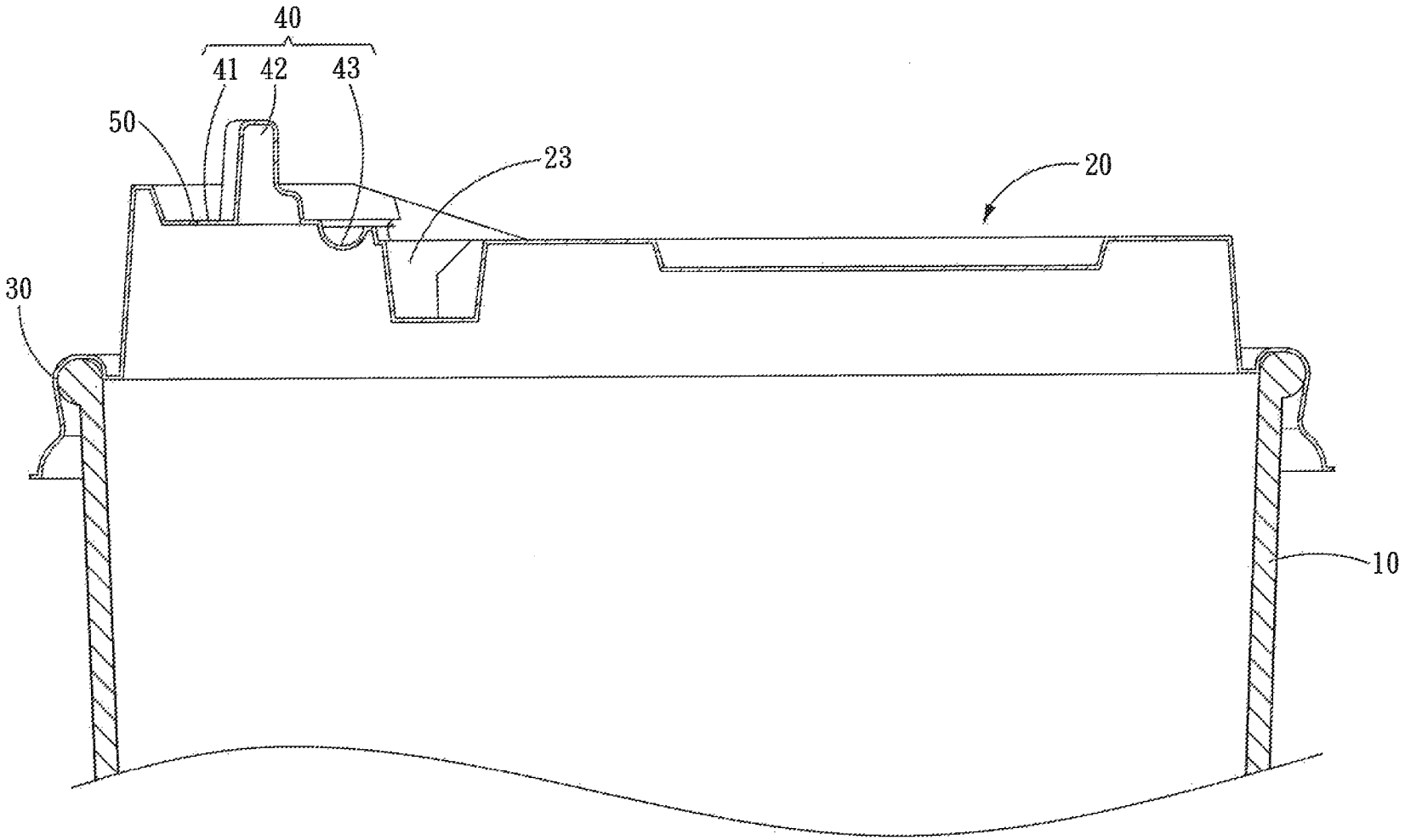
FIGS. 2A through 2C are schematic views of the invention in use conditions.

Please refer to FIGS. 1A and 1B, the present invention aims to provide a ventilation cup lid to cover a cup 10 (also referring to FIG. 2A). The ventilation cup lid includes a lid 20, a sealing portion 30 connected to one side of the lid 20, and an orifice sealing member 40 located on the lid 20. The lid 20 has a drinking orifice 21 (referring to FIG. 2B), a severed coupling portion 22 extended from the lid 20 to the drinking orifice 21, and a wedge notch 23. The sealing portion 30 mates the opening of the cup 10 to enable the lid 20 to be securely mounted onto the cup 10. The orifice sealing member 40 corresponds to the drinking orifice 21 and includes a cover sheet 41, a protrusive latch portion 42 located at one side of the cover sheet 41 remote from the cup 10, and a bent connecting section 43 to bridge the cover sheet 41 and lid 20. The bent connecting section 43 is located between the wedge notch 23 and cover sheet 41. The cover sheet 41 and lid 20 are interposed by a ventilation gap 50. The severed coupling portion 22 strides the ventilation gap 50 to connect to the cover sheet 41. The cover sheet 41 is mounted onto the drinking orifice 21 through the severed coupling portion 22 and bent connecting section 43.

More specifically, in this embodiment, the severed coupling portion 22 has an angular end 221 which is formed in a triangular shape and connected to the cover sheet 41. Through the design of the angular end 221, the connecting strength of the cover sheet 41 and lid 20 is reduced so that a user can break off the severed coupling portion 22 by pushing the protrusive latch portion 42 without too much effort to facilitate using. In addition, the protrusive latch portion 42 has a contact concave wall 421 at one side abutting the severed coupling portion 22 to give the user more desirable tactile feel during pushing the protrusive latch portion 42. Moreover, the ventilation cup lid is integrally made of plastics. Then two sides of the ventilation cup lid adjacent to and remote from the protrusive latch portion 42 are cut via two cutters (not shown in the drawings) to mate the shape of the severed coupling portion 22 so that the triangular severed coupling portion 22 is formed with the angular end 221 connected to the cover sheet 41. Furthermore, in this embodiment, the severed coupling portion 22 is located at one side of the drinking orifice 21 remote from the wedge notch 23, thereby the user can exert a force on the protrusive latch portion 42 to break off the severed coupling portion 22 remote from the bent connecting section 43 which serves as a fulcrum via a lever principle.

Figure 2B:
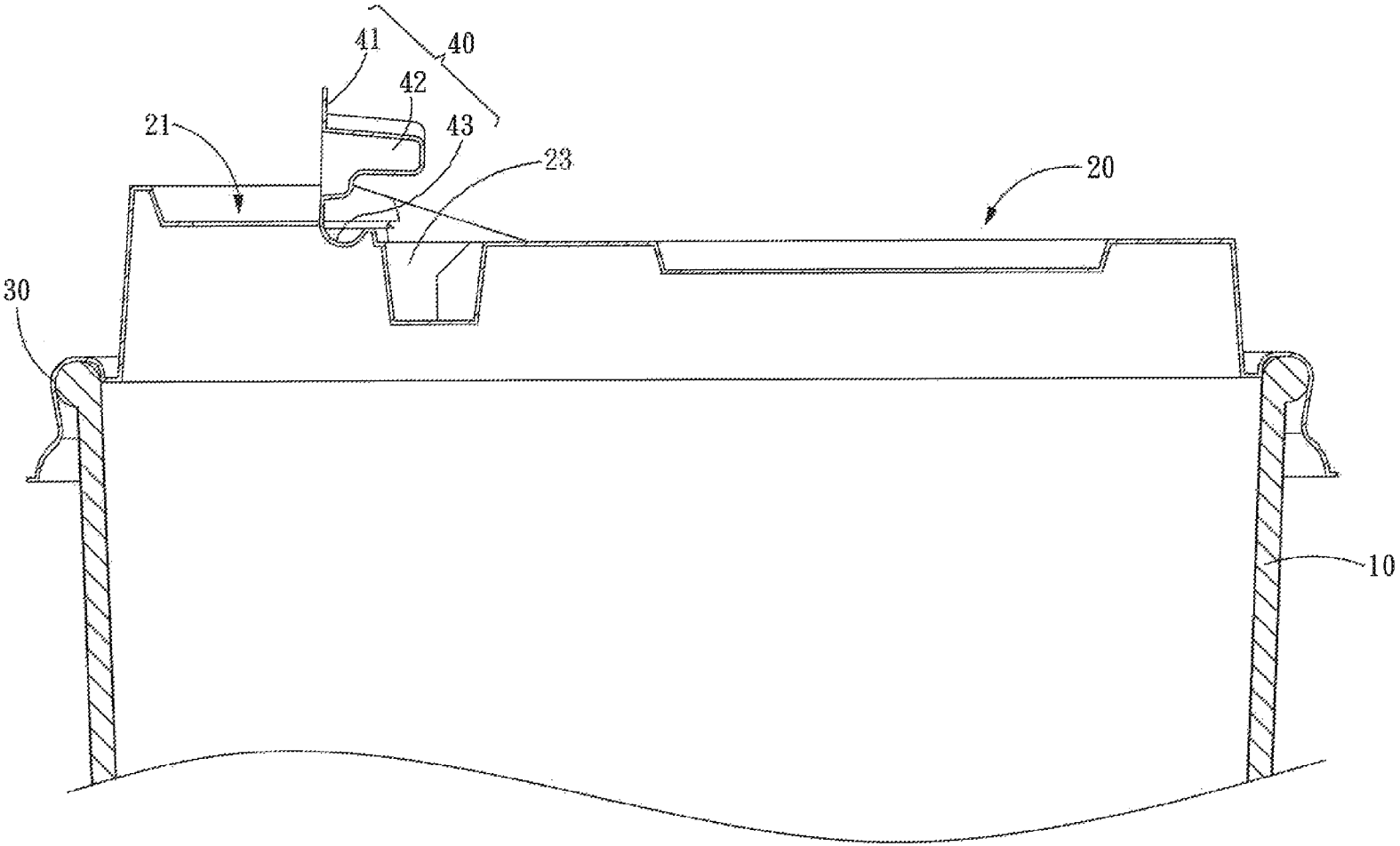
Figure 2C:
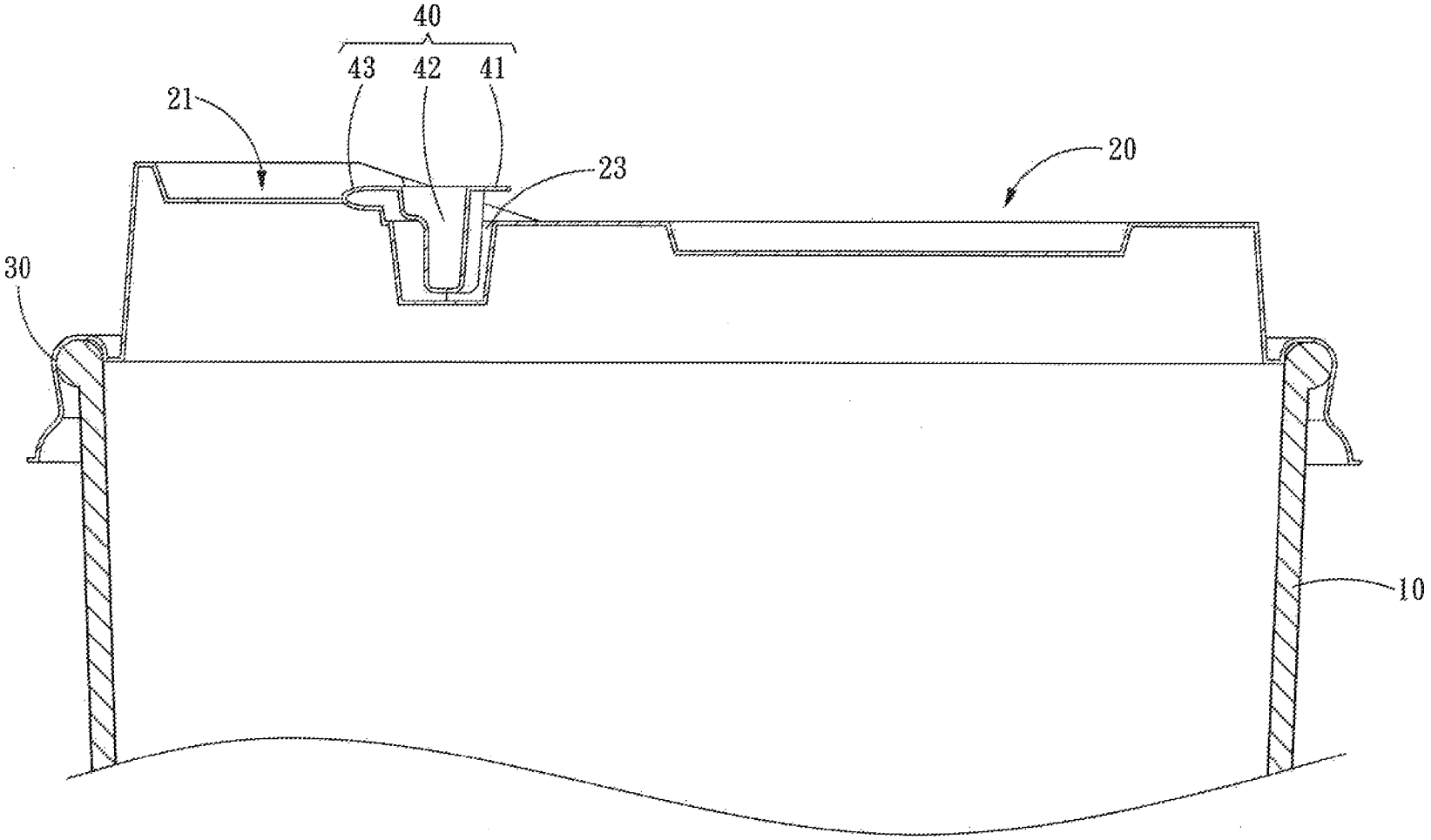

When the invention is in use, the operation steps involved are discussed by referring to FIGS. 2A through 2C as follows. It is to be noted that, as showing the severed coupling portion 22 and ventilation gap 50 at the same time in the sectional drawings are cumbersome, the severed coupling portion 22 is omitted in FIGS. 2A through 2C, and only movements of the cup lid and forming of the ventilation gap 50 are discussed. Please refer to FIG. 2A, when the cup lid is not yet been used, the protrusive latch portion 42 is at a closed position with the cover sheet 41 mounted onto the drinking orifice 21 so that thermal pressure can be released and hot air also can be dissipated through the ventilation gap 50. The severed coupling portion 22 (as shown in FIG. 1A) is connected to the cover sheet 41 and lid 20. In FIG. 2B, the protrusive latch portion 42 is pushed by a user to break off the severed coupling portion 22 so that the cover sheet 41 and lid 20 are separated and the cover sheet 41 swivels about the bent connecting section 43 serving as the axis to expose the drinking orifice 21. Finally, as shown in FIG. 2C, the protrusive latch portion 42 can latch in the wedge notch 23 to expose the drinking orifice 21 so that the user can drink the hot beverage in the cup 10.

Figure 3:
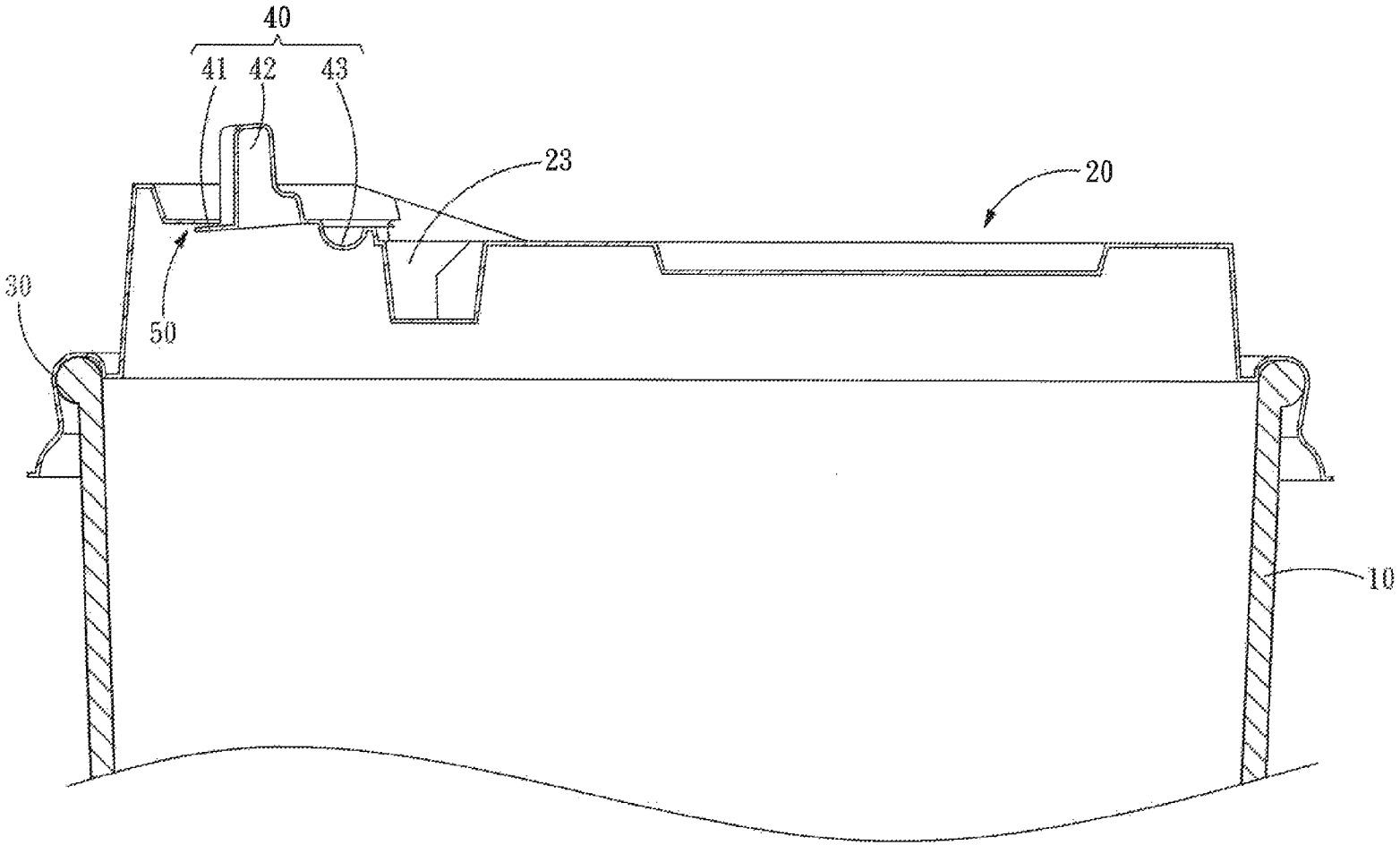
FIG. 3 is a fragmentary sectional view of another embodiment of the invention.
Figure 4:
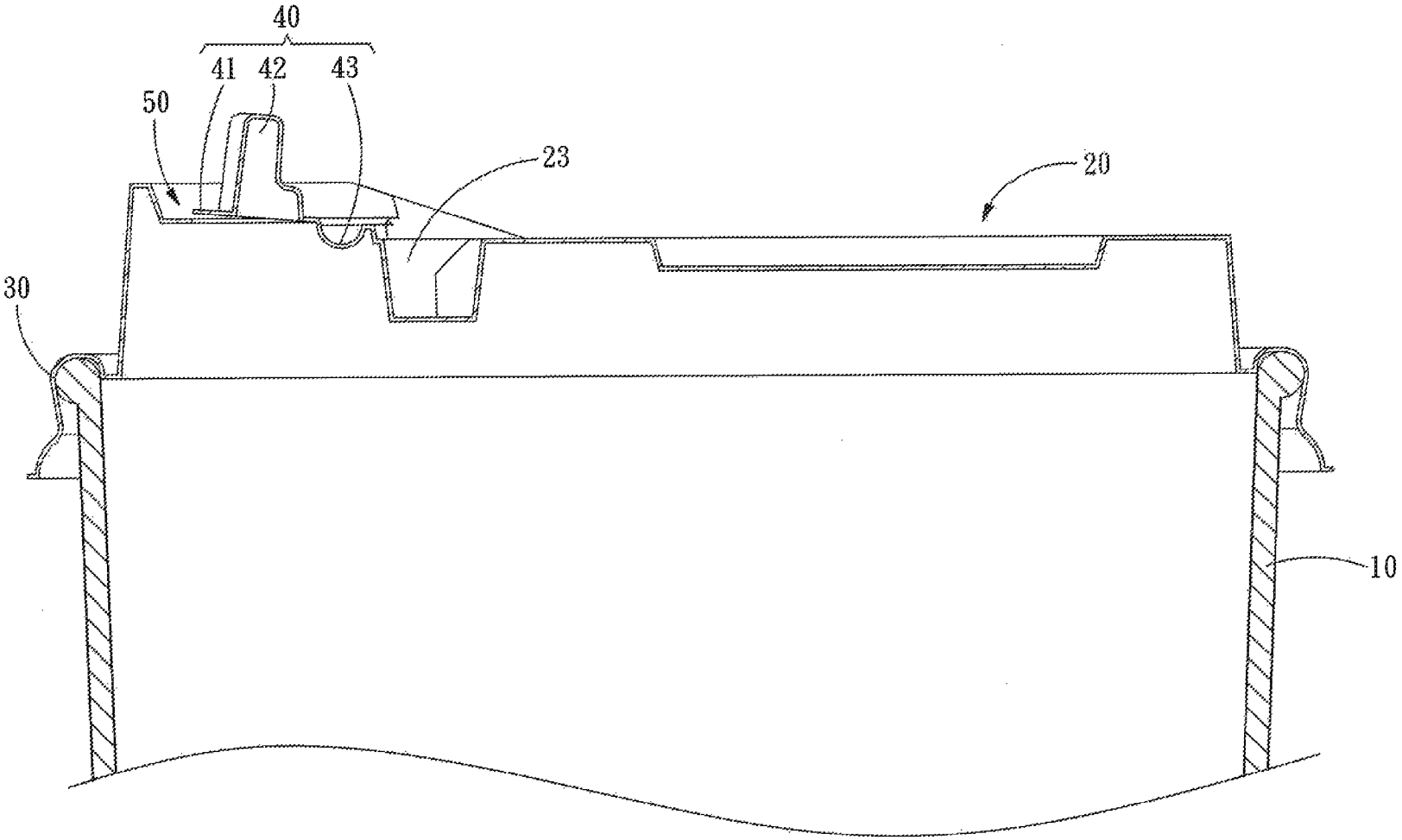
FIG. 4 is a fragmentary sectional view of yet another embodiment of the invention.

Aside from forming the cover sheet 41 and lid 20 at the same plane with the ventilation gap 50 formed by cutting via a cutter, FIG. 3 illustrates another embodiment in which the lid 20 has one side where the severed coupling portion 22 is located at a plane different from the cover sheet 41 to form the ventilation gap 50 between the lid 20 and cover sheet 41, i.e., to form the ventilation gap 50 through elevation difference. In FIG. 3, the cover sheet 41 is slightly lower than the lid 20 in elevation to form the ventilation gap 50. FIG. 4 shows yet another embodiment in which the cover sheet 41 is slightly higher than the lid 20 in elevation to form the ventilation gap 50. It is to be noted that the severed coupling portion 22 also is omitted in FIGS. 3 and 4 to facilitate discussion of the structure of the ventilation gap 50.

As a conclusion, compared with the conventional techniques, the invention provides features as follows:

1. The ventilation gap is formed between the cover sheet and lid to improve heat dissipation and pressure balance efficacy.
2. The cover sheet and lid are connected merely by the severed coupling portion, so that the connection between the cover sheet and lid can be easily broken off by a user by pushing the protrusive latch portion, hence can better meet use requirement.
3. The severed coupling portion is located at one side of the drinking orifice remote from the wedge notch so that the user can only exert a small amount of forces to break off the severed coupling portion via the lever principle to further improve usability.
4. The ventilation gap can be easily formed between one side of the lid where the severed coupling portion is located and the cover sheet through the elevation difference.

What is claimed is:

1. A ventilation cup lid to cover a cup, comprising:

a lid including a drinking orifice, a severed coupling portion extended from the lid to the drinking orifice, and a wedge notch;

a sealing portion connected to one side of the lid to mate an opening of the cup such that the lid is mounted onto the cup through the sealing portion; and an orifice sealing member which is located on the lid corresponding to the drinking orifice and includes a cover sheet, a protrusive latch portion at one side of the cover sheet remote from the cup, and a bent connecting section to bridge the cover sheet and the lid, the bent connecting section being located between the wedge notch and the cover sheet, the cover sheet partially covering the drinking orifice and forming a ventilation gap between the cover sheet and the lid, the severed coupling portion striding the ventilation gap to connect to the cover sheet such that the cover sheet is mounted onto the drinking orifice through the severed coupling portion and the bent connecting section, the protrusive latch portion including a contact concave surface at one side abutting the severed coupling portion.

2. The ventilation cup lid of claim 1, wherein the severed coupling portion is located at one side of the drinking orifice remote from the wedge notch.

3. The ventilation cup lid of claim 2, wherein the lid includes one side where the severed coupling portion is located at a plane different from the cover sheet so that the ventilation gap is formed between the lid and the cover sheet.

4. The ventilation cup lid of claim 1, wherein the severed coupling portion includes an angular end connecting to the cover sheet.

* * * * *